US005678813A

United States Patent [19]

Osako et al.

[11] Patent Number: 5,678,813

[45] Date of Patent: Oct. 21, 1997

[54] BOOK-BINDING METHOD FOR SADDLE-STITCHED BOUND BOOK

[75] Inventors: Tatsuo Osako; Takaaki Osako, both of Urawa, Japan

[73] Assignee: Kabushiki Kaisha Osako Seisakusho, Urawa, Japan

[21] Appl. No.: 613,313

[22] Filed: Mar. 11, 1996

[30] Foreign Application Priority Data

| | | | |
|---|---|---|---|
| Mar. 15, 1995 | [JP] | Japan | 7-083419 |
| Aug. 30, 1995 | [JP] | Japan | 7-246848 |
| Aug. 30, 1995 | [JP] | Japan | 7-246849 |

[51] Int. Cl.[6] ..... B65H 39/00; B42C 11/00

[52] U.S. Cl. ..... 270/52.16; 270/52.18; 270/52.29; 412/4; 412/6; 412/19; 412/35; 412/37

[58] Field of Search ..... 270/52.14, 52.16, 270/52.18, 52.26, 52.29; 412/1, 4, 6, 8, 9, 22, 17, 18, 19, 20, 21, 33, 35, 36, 37

[56] References Cited

FOREIGN PATENT DOCUMENTS 47-29445 9/1972 Japan .

63-5900 2/1988 Japan .

329169 6/1991 Japan .

*Primary Examiner*—Hoang Nguyen

*Attorney, Agent, or Firm*—Browdy and Neimark

[57] ABSTRACT

A bookbinding method includes feeding body signatures 2a, from a plurality of body signature feeders 4 disposed in parallel, to conveyor 1 below the body signature feeders 4 and stacking the body signatures 2a on the conveyor 1; obtaining a back-saddle-stitched book a of the body signatures 2a by back-saddle-stitching a back portion of the stacked body signatures 2a from below; spraying paste 9 along a predetermined width on a back surface of the back-saddle-stitched book a; feeding a cover signature 2a from a cover signature feeder 10 to the top of the back-saddle-stitched book a; pressing a back side of the cover signature 2a via pressing apparatus 11 and bonding the cover signature 2a to a back side of the back-saddle-stitched book a; and cutting head, tail and fore edge margins via a three-side trimmer to obtain a saddle-stitched bound book.

4 Claims, 7 Drawing Sheets

BOOK-BINDING METHOD FOR SADDLE-STITCHED BOUND BOOK

FIELD OF THE INVENTION

The present invention relates to an improvement in a bookbinding method for saddle-stitched bound books which have high safety and suffer less damage.

DESCRIPTION OF THE RELATED ART

For example, some textbooks which are lent to school children by the Ministry of Education are saddle-stitched textbooks the stitching wire of which is exposed inwardly at its opposite bent ends as a bare wire. Children may unbend the bent end portions of such stitching wire out of mischief and pull out the stitching wire from their textbooks to break them up, or they may run the risk of hurting their fingers during such mischief. For these reasons, in recent years, the Ministry of Education has issued instructions to saddle-stitch this kind of saddle-stitched textbook for schoolchildren from the inside of the textbook toward the outside thereof. As is well known, this kind of saddle-stitched textbook is bound by saddle-stitching signatures by means of a body signature feeder, a cover signature feeder, a two-parallel-chain type of conveying chain mechanism which corresponds to these feeders, and a stitcher mechanism, and then cutting the saddle-stitched signatures by means of a three-side trimmer. However, if such a conventional apparatus is used to prepare textbooks with signatures folded in the conventional manner, back-saddle-stitched textbooks such as those specified by the Ministry of Eduction are not obtained. For this reason, textbook manufacturers have presently obtained back-saddle-stitched textbooks by first gathering a cover signature and placing it on a conveying chain mechanism by means of a cover signature feeder in the opposite order to the conventional order, sequentially gathering body signatures and putting them on the cover signature, performing saddle-stitching using a stitcher mechanism by the same means as the conventional stitching method, folding the entire saddle-stitched textbook in the opposite direction, gluing cloth to the entire length of the back of the book by means of a cloth gluing machine so as to cover the bent end portions of a stitching wire appearing on the outside surface of the book, and cutting three sides thereof.

However, since the signatures are mechanically folded, the resultant folds are hard and sharp, so that it is extremely difficult to fold back the saddle-stitched book obtained by stacking a multiplicity of signatures having such folds and it is impossible to perfectly reverse the saddle-stitched book along the first fold. This leads to a number of problems; for example, if the obtained book is opened, an illustration or the like printed over adjacent pages may show a discrepancy or disagreement, so that an unnecessary portion of another page may be exposed. Particularly in the case of maps or the like, there are serious problems such as the problem that some maps cannot be used for school work owing to a discrepancy in line between adjacent pages. In addition, there is the problem that an increase in the number of process steps leads to an increases in cost.

To cope with these problems, Japanese Utility Model Publication No. 29445/1972 discloses means which is intended to saddle-stitch books without the use of a stitching wire by sticking a hollow needle, which has a helical groove around its periphery, into signatures from below the signatures in the upward direction while the signatures are being conveyed on a guide plate having a mountain-like shape, and penetrating a liquid adhesive discharged from the hollow needle into a hole portion into which the needle is stuck. It is considered that the saddle-stitched book obtained from this apparatus is advantageous in that a stitching wire or the like is not exposed from the saddle-stitched book and an illustration or the like is not impaired by this stitching wire and in that the saddle-stitched book is safe and inexpensive because no stitching wire is used. However, since the helical groove is provided around the hollow needle, inward fine splits are produced in the signatures when the hollow needle is pulled while it is being rotated, so that the aesthetic effect of an illustration may be impaired to a greater extent than when stitching wires are used. In addition, the saddle-stitched book obtained from the apparatus has the disadvantage that if the signatures are subjected to finish cutting by a three-side trimmer before the liquid adhesive gets dry, some pages of a middle folded section are bonded, so that the pages may be damaged when the book is opened. In addition, a large-scale apparatus is needed and the total cost of the book is high.

Furthermore, in a bookbinding apparatus for saddle-stitched books which employs a saddle-stitching machine, after a signature which finally becomes a cover is laid on the top of sequentially stacked signatures, the signatures are saddle-stitched by a stitcher mechanism to prepare a bound book. This kind of bound book is inferior in appearance because a stitching wire appears on the back side of the cover. In recent years, some kinds of saddle-stitched books have been bound by bonding only a cover to other signatures with paste after the saddle-stitching of the signatures without saddle-stitching the cover and the signatures at the same time by a saddle-stitching machine. This kind of book is obtained by bonding a cover to a book, which has no cover and is bound by a saddle-stitching machine, with paste by means of another machine. The efficiency of bookbinding of this kind of book is low because at least two separate bookbinding operations are needed, and also the problem of economy occurs because expensive bookbinding machines and facilities are required.

[PRIOR ART AND ITS PROBLEMS]

As means for solving the above-described problems, the present applicant has proposed the back-saddle-stitching apparatus disclosed in Japanese Utility Model Publication No. 5900/1988 which was published in the state of Japan, as well as the saddle-stitching bookbinding apparatus disclosed in Japanese Utility Model Publication No. 29169/1991, which apparatus is arranged to bind a book with paste after a cover is saddle-stitched, so that a stitching wire is prevented from appearing on the surface of the bound book. In the former back-saddle-stitching apparatus in which body signatures and cover signatures which are sequentially fed from a folding-feeding machine (feeder) to a guide plate having a mountain-like shape are sequentially gathered and conveyed by a conveying chain mechanism using two parallel chains and the signatures are saddle-stitched by a stitcher mechanism which is provided halfway along the line of the conveying chain mechanism and is arranged to move back and forth by the required stroke along this line, a stitching member which constitutes part of the stitcher mechanism and saddle-stitches the signatures from below is disposed below the guide plate, and a stitching-wire pressing member which corresponds to the stitching member is provided above the guide plate.

In the case of the saddle-stitched book obtained from the former back-saddle-stitching apparatus, the opposite bent end portions of each stitching wire are exposed on the back surface of the cover, so that it is possible to prevent the signatures from coming apart in the inside of the saddle-stitched book. However, it is easy for children to touch the opposite bent end portions of the stitching wire which appears on the surface of the book, and there remains the problem of rather increasing the danger of breaking up the book or hurting their fingers during mischief.

In the latter saddle-stitching apparatus, a required number of signature feeders are disposed above the upstream side of an endless chain which is arranged to extend horizontally with respect to a machine frame and which is provided with carrying elements for carrying signatures by engaging with both sides of the top of the rear end of the signatures which are mounted at equal intervals, a stitcher mechanism is disposed on the downstream side of the signature feeders so that it can be intermittently moved up and down, and a pasting apparatus having an applying member which is elastically disposed for upward and downward movement and comes into contact with the back surface of the stacked signatures which are moving, and applies paste to the back surface along the entire length thereof, is provided on the downstream side of the stitcher mechanism. In addition, a cover signature feeder for feeding a cover signature is disposed on the downstream side of the pasting apparatus, and a pressure roller of V-shaped cross section which is elastically disposed for upward and downward movement to press the back surface of the cover signature is disposed on the downstream side of the cover signature feeder.

The saddle-stitched book obtained from the latter apparatus has the advantage of having a feeling of quality since each stitching wire to appear on the surface of its back is hidden by the cover. However, since the opposite bent end portions of each stitching wire is exposed in the inside of the book, it is impossible to eliminate the danger that children break up the book out of mischief and hurt their fingers. Furthermore, since paste applying means in this apparatus is of a contact type, means for coping with variations of the thickness of stacked signatures is complicated. In addition, since paste is applied over the entire length of the surface of the signatures, when the head and tail margins of a saddle-stitched book are cut and aligned by a three-side trimmer which constitutes a post-processing step, the paste may adhere to a cutter and impair the sharpness of the cutter. As a result, an interruption of the operation of the entire machine is needed to clean the cutter, so that the efficiency of bookbinding will be impaired.

OBJECTS AND SUMMARY OF THE INVENTION

An object of the present invention is to provide a bookbinding method which is capable of reasonably preventing children or the like from damaging saddle-stitched books or hurting themselves out of mischief, and which is capable of improving the efficiency of bookbinding to a further extent.

The above object is achieved by the steps of feeding body signatures from a plurality of body signature feeders which are disposed in parallel to conveying means below the body signature feeders and stacking the body signatures on the conveying means, obtaining a back-saddle-stitched book of the body signatures by back-saddle-stitching a back portion of the stacked body signatures from below, spraying paste along a predetermined width on a back surface of the back-saddle-stitched book, feeding a cover signature from a cover signature feeder to the top of the back-saddle-stitched book, pressing a back side of the cover signature via pressing means and bonding the cover signature to a back side of the back-saddle-stitched book, and obtaining a saddle-stitched bound book by cutting head, tail and fore edge margins via a three-side trimmer.

The above object is achieved by a bookbinding method for a saddle-stitched bound book according to claim 1, characterized in that the paste is sprayed onto a back portion of the back-saddle-stitched book which excludes front and rear predetermined lengths of the back portion of the back-saddle-stitched book.

The above object is achieved by the steps of: sequentially feeding body signatures from a plurality of body signature feeders which are disposed in parallel to conveying means below the body signature feeders and stacking the body signatures on the conveying means; obtaining a back-saddle-stitched book of the body signatures by back-saddle-stitching a back portion of the stacked body signatures from below; sequentially transferring the obtained back-saddle-stitched book to clamping means of another conveying means in a 180°-reversed attitude with its back facing down; spraying paste onto the down-facing back of the back-saddle-stitched book halfway during conveyance by the conveying means; feeding the back-saddle-stitched book sprayed with the paste to the top of a cover signature which is fed from a cover signature feeder to a downstream side of the conveying means and is on standby in a temporarily stopped state independently of a motion of the conveying means; bonding the cover signature to the back side of the back-saddle-stitched book by clamping the back side via still another clamping means while conveying the back-saddle-stitched book together with the cover signature; and, after releasing the back-saddle-stitched book from the clamping means, decoratively cutting head, tail and fore edge margins by using a three-side trimmer to obtain a saddle-stitched bound book.

The above object is achieved by the steps of: sequentially feeding body signatures from a plurality of body signature feeders which are disposed in parallel to conveying means below the body signature feeders and stacking the body signatures on the conveying means; obtaining a front-saddle-stitched book of the body signatures by saddle-stitching a back portion of the stacked body signatures from above; feeding the front-saddle-stitched book to a front-saddle-stitched signature feeder; meanwhile, sequentially feeding body signatures from a plurality of body signature feeders which are disposed in parallel to conveying means below the body signature feeders and stacking the body signatures on the conveying means; obtaining a back-saddle-stitched book of the body signatures by back-saddle-stitching a back portion of the stacked body signatures from below; spraying paste along a predetermined width on a back surface of the back-saddle-stitched book; feeding the front-saddle-stitched book from the front-saddle-stitched signature feeder to the top of the back-saddle-stitched book; bonding the front-saddle-stitched book to a back side of the back-saddle-stitched book to obtain a composite saddle-stitched book; and obtaining a saddle-stitched bound book by cutting head, tail and fore edge margins of the composite saddle-stitched book via a three-side trimmer.

The above object is achieved by the steps of: sequentially feeding body signatures from a plurality of body signature feeders which are disposed in parallel to conveying means below the body signature feeders and stacking the body signatures on the conveying means; obtaining a front-saddle-stitched book of the body signatures by saddle-stitching a back portion of the stacked body signatures from above; feeding the front-saddle-stitched book to a front-saddle-stitched signature feeder; meanwhile, sequentially feeding body signatures from a plurality of body signature feeders which are disposed in parallel to conveying means below the body signature feeders and stacking the body signatures on the conveying means; obtaining a back-saddle-stitched book of the body signatures by back-saddle-stitching a back portion of the stacked body signatures from below; spraying paste along a predetermined width on a back surface of the back-saddle-stitched book; feeding the front-saddle-stitched book from the front-saddle-stitched signature feeder to the top of the back-saddle-stitched book; bonding the front-saddle-stitched book to a back side of the back-saddle-stitched book to obtain a composite saddle-stitched book; sequentially transferring the composite saddle-stitched book to clamping means of another conveying means in a 180°-reversed attitude with its back facing down; spraying paste onto the lower surface of a back portion of the composite saddle-stitched book halfway during conveyance by the conveying means; feeding the composite saddle-stitched book sprayed with the paste to the top of a cover signature which is fed from a cover signature feeder to a downstream side of the conveying means and is on standby in a temporarily stopped state independently of a motion of the conveying means; bonding the cover signature to the back side of the composite saddle-stitched book by clamping the back side via anther clamping means while conveying the composite saddle-stitched book together with the cover signature; and, after releasing the composite saddle-stitched book from the clamping means, decoratively cutting head, tail and fore edge margins by using a three-side trimmer to obtain a saddle-stitched bound book.

BRIEF DESCRIPTION OF THE DRAWING FIGURES

The above and other objects and the nature and advantages of the present invention will become more apparent from the following detailed description of an embodiment taken in conjunction with drawings, wherein.

DETAILED DESCRIPTION OF THE PREFERRED EMBODIMENTS

The details of embodiments of the present invention will be described with reference to the accompanying drawings.

Figure 1:
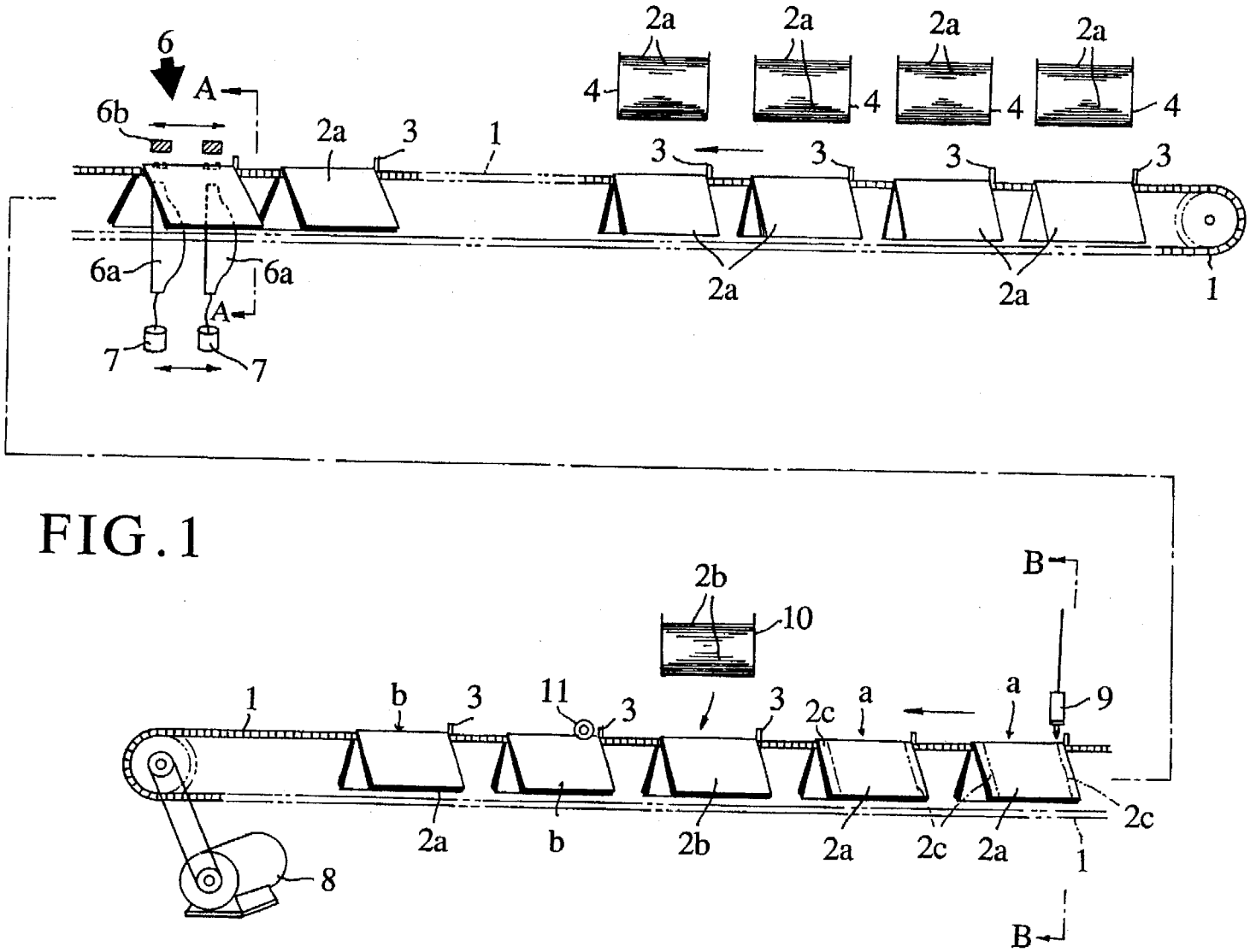
FIG. 1 is a partially schematic exploded perspective view of the back-saddle stitching apparatus of the invention.
Figure 2:
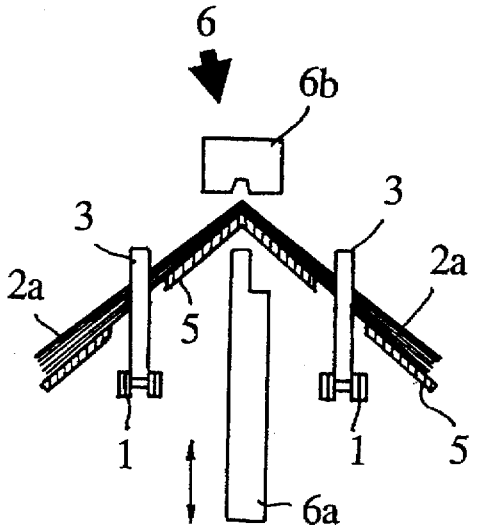
FIG. 2 is a cross-sectional view taken along line A—A of FIG. 1.
Figure 3:
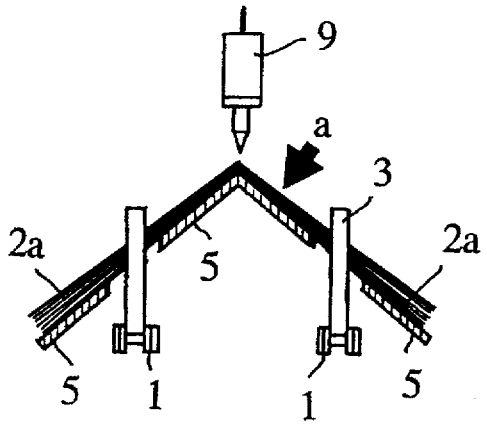
FIG. 3 is a cross-sectional view taken along line B—B of FIG. 1.
Figure 4:
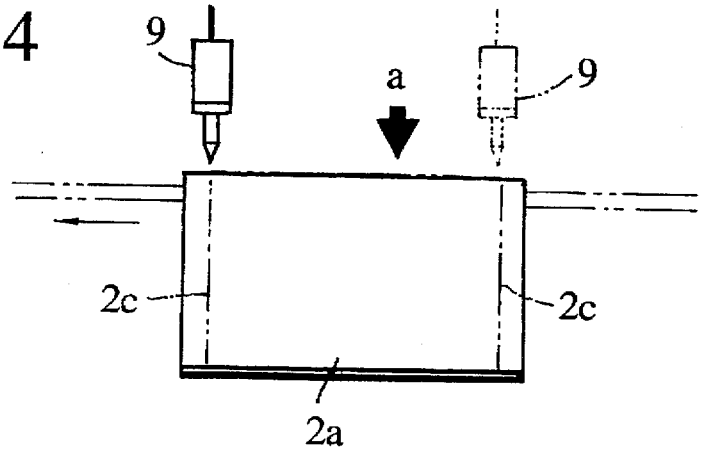
FIG. 4 is a front elevational view of a back-saddle-stitched book, showing a paste spraying area.

FIGS. 1 to 4 show embodiments which correspond to claims 1 and 2. In FIG. 1, reference numeral 1 denotes a long conveying chain mechanism which is installed perpendicularly with respect to a machine frame which is not shown, and the conveying chain mechanism 1 is made up of a set of two parallel chains, as shown in FIG. 2. Pusher mechanisms 3 are disposed at predetermined intervals along this conveying chain mechanism 1 so that they can be brought into abutment with both sides of the rear ends of body signatures 2*a* and cover signatures 2*b* which will be described later, to carry these signatures at a predetermined conveying speed. A plurality of body-signature feeders 4 which are needed for saddle-stitching bookbinding are disposed in parallel above the upstream side of the conveying chain mechanism 1, and the required number of body signatures 2*a* fed from the respective body-signature feeders 4 are sequentially stacked, and are conveyed toward the downstream side by the conveying chain mechanism 1 and the pusher mechanisms 3. In FIGS. 2 and 3, reference numeral 5 denotes a guide plate for saddle-supporting the body signatures 2*a* which are opened outwardly in the shape of a mountain, in front elevation.

Stitching members 6*a*, which travel at the same speed and in the same direction as the conveying chain mechanism 1 to saddle-stitch the gathered body signatures 2*a* from below and form a back-saddle-stitched book a, are uprightly provided below the middle portion of the guide plate 5 which is located at the portion of the conveying chain mechanism 1 which is beyond the body-signature feeder 4 located on the most downstream side. Stitching-wire pressing members 6*b* which are moved back and forth in correspondence with the respective stitching members 6*a* are adjacently provided above the back of the body signatures 2*a*. The aforesaid stitcher mechanism 6 is made up of the stitching members 6*a* and the stitching-wire pressing members 6*b*. In FIG. 1, reference numeral 7 denotes a steel-wire bobbin, and reference numeral 8 denotes a driving motor.

A nozzle 9 for spraying paste downwardly is disposed so that it can be adjustably moved up and down, on the downstream side of the stitcher mechanism 6 and above the conveying chain mechanism 1, more specifically, at a position above the conveying chain mechanism 1 where the nozzle 9 does not contact the back surface of the back-saddle-stitched book a which consists of the body signatures 2*a* which are moving. The nozzle 9 is arranged to be operated by, for example, a controller which receives a collator speed signal from a rotary encoder, and is capable of performing spot-spraying with paste, intermittent spraying, continuous spraying, and automatic spraying according to the length of the body signatures 2*a*. In particular, the nozzle 9 can be controlled so that the paste can be sprayed onto a back portion excluding head and tail margins 2*c* of the respective front and rear end portions of the back of the body signatures 2*a*, i.e., the back-saddle-stitched book a.

In addition, a cover signature feeder 10 for feeding a cover signature 2*b* to the top of the pasted back-saddle-stitched book a is disposed above the downstream side of the nozzle 9, and a pressure roller 11 for pressing the back of the fed cover signature 2*b* from above and accurately bonding the cover signature 2*b* to the surface of the pasted back-saddle-stitched book a is disposed on the downstream side of the cover signature feeder 10. The pressure roller 11 has clamping means for uniformly pressing the entire area of the back side or a V-shaped cross section for partially pressing the back side. Although not specifically shown, this pressure roller 11 is urged downwardly by a spring or the like and can be moved up and down according to variations in the thickness of the signatures. In the present embodiment, an illustration of the three-side trimmer is omitted.

A bookbinding method using the above-described back-saddle-stitching apparatus will be described.

The body signatures 2a are sequentially fed downwardly from the plurality of body-signature feeders 4 to the conveying chain mechanism 1, and the back of the stacked body signatures 2a is back-stitched from below by the stitching members 6a and the stitching-wire pressing members 6b of the stitcher mechanism 6. After a paste margin of predetermined width and the back surface of this back-saddle-stitched book a which excludes the head and tail margins 2c are sprayed with the paste through the nozzle 9, the cover signature 2b is fed from the cover signature feeder 10 to the back-saddle-stitched book a, and the cover signature 2b is bonded to the back of the back-saddle-stitched book a by pressing the pressure roller 11 against the back of the cover signature 2b. Thus, a saddle-stitched book b is prepared with the back-saddle-stitched book a being hidden by the cover signature 2b. Then, the head and tail margins of this saddle-stitched book b are cut from the respective portions of the head and tail margins 2c and its fore edge margin is also cut from the saddle-stitched book b, by the three-side trimmer (not shown), thus providing the back-saddle-stitched book.

Figure 5:
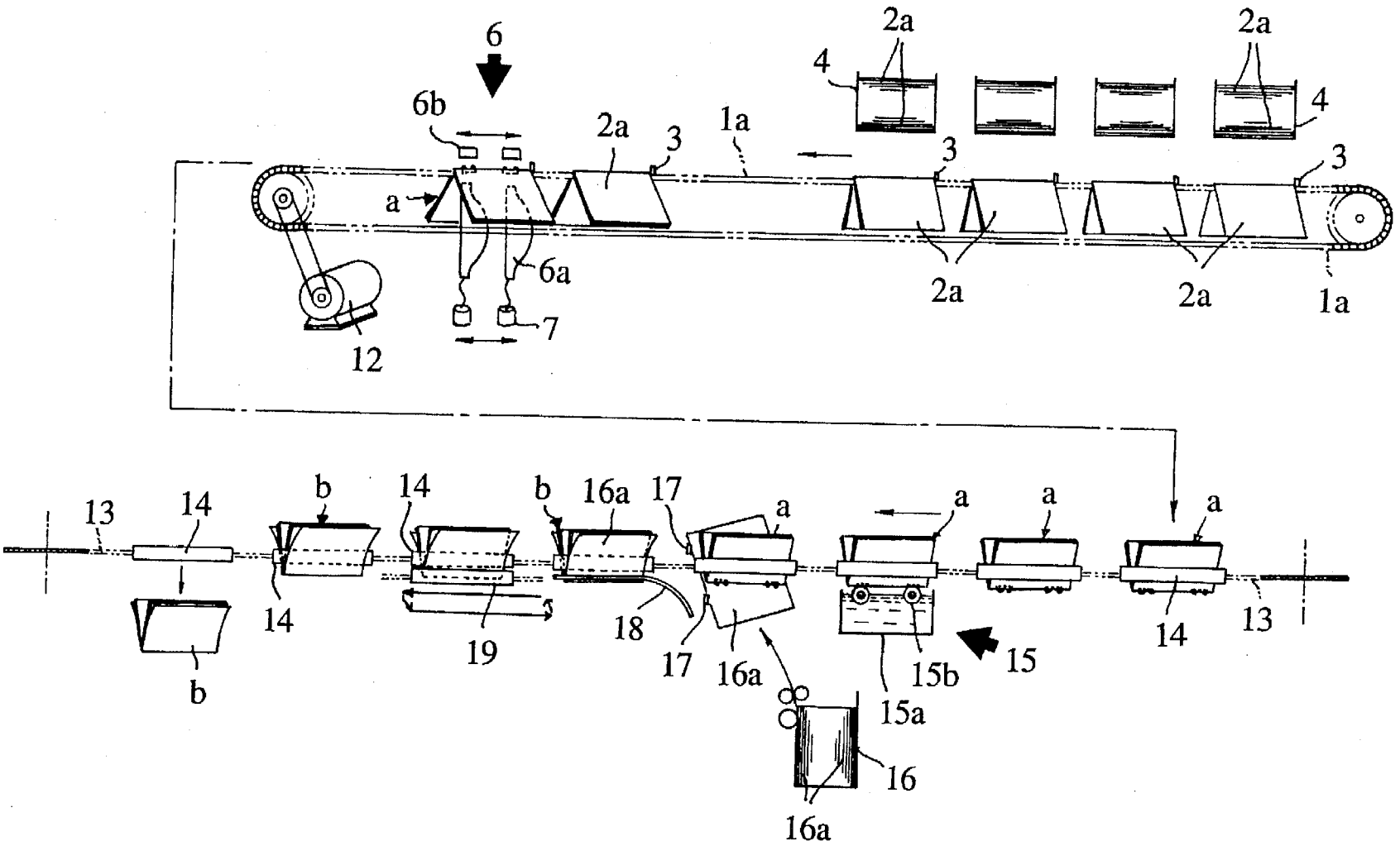
FIG. 5 is an explanatory view of another embodiment.

FIG. 5 shows an embodiment which corresponds to claim 3. Reference numeral 1a denotes a conveying chain mechanism having a structure for independently driving two parallel chains which are installed perpendicularly with respect to a machine frame which is not shown. Identical reference numerals are used to denote structures identical to those of the first embodiment described above, and the detailed description thereof is omitted. Reference numeral 12 denotes a driving motor for the conveying chain mechanism 1a.

Reference numeral 13 denotes a conveying chain mechanism which is installed so that a forward path and a backward path horizontally turn with respect to the machine frame which is not shown. The conveyance terminal end of the conveying chain mechanism 1a and the conveyance starting end of the backward path of the conveying chain mechanism 13 are connected by means for reversing the back-saddle-stitched book a by 180°. Clamping means 14 for clamping the right and left intermediate portions of the aforesaid back-saddle-stitched books a are attached to the conveying chain mechanism 13 at predetermined intervals, and a device 15 for applying paste to the back of the back-saddle-stitched book a is disposed below a halfway portion of the backward path of the conveying chain mechanism 13. The paste applying device 15 is arranged to uniformly apply the paste contained in a tank 15a, by touch with two parallel rotating rollers 15b, and it is desirable that the paste applying device 15 can be adjustably moved up and down so that its touch with the back of the back-saddle-stitched book a can be made uniform.

A cover feeder 16 is disposed below the downstream side of the paste applying device 15, and stoppers 17 for temporarily stopping one flat cover 16a, which is fed from the cover feeder 16, independently of the backward run of the conveying chain mechanism 13 are provided so that they can move up and down in the state of opposing each other across the chain. In addition, a guide rod 18 for pressing and bonding the cover 16a to the back of the back-saddle-stitched book a which is clamped and supported by the clamping means 14 in the state of being folded upwardly into two along the center line is provided on the downstream side of the stoppers 17. Clamping means 19, which is positioned below the clamping means 14 and clamps and supports both sides of the back of the back-saddle-stitched book a by a short distance, is disposed on the downstream side of the guide rod 18. This clamping means 19 is arranged to be able to perform operations, i.e., clamping the back, separation, returning and clamping the back, with good timing within a limited section, as indicated by arrows. At the terminal end of the backward path of the conveying chain mechanism 13, the clamping and supporting by the clamping means 14 is released and the saddle-stitched book b is obtained with the exposed portion of the stitching wire of the back-saddle-stitched book a being hidden by the cover 16a. Then, the head, tail and fore edge margins of this saddle-stitched book b are decoratively cut by a three-side trimmer (not shown), thus providing a back-saddle-stitched book.

Figure 6:
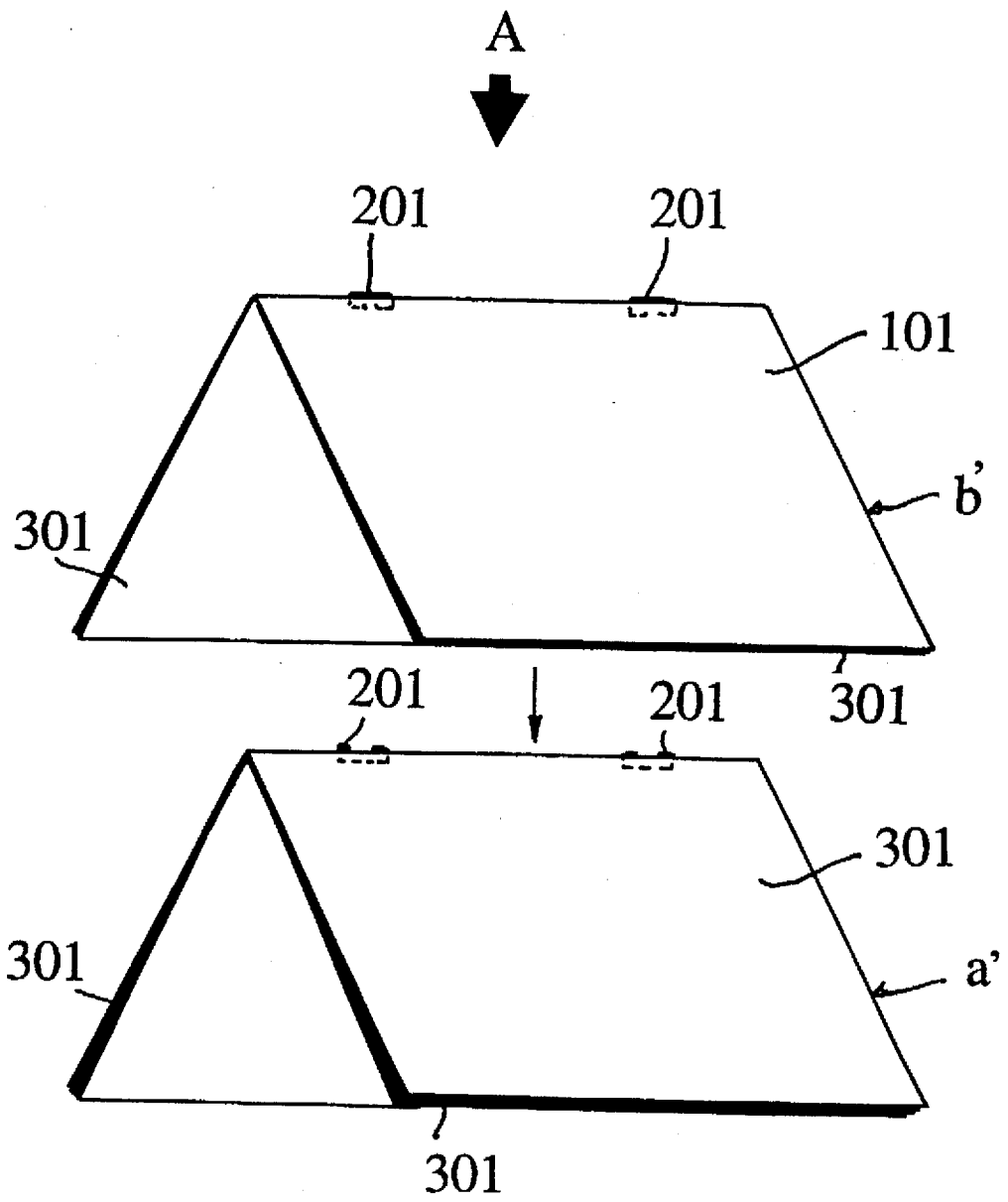
FIG. 6 is an exploded perspective view of a saddle-stitched book.
Figure 7:
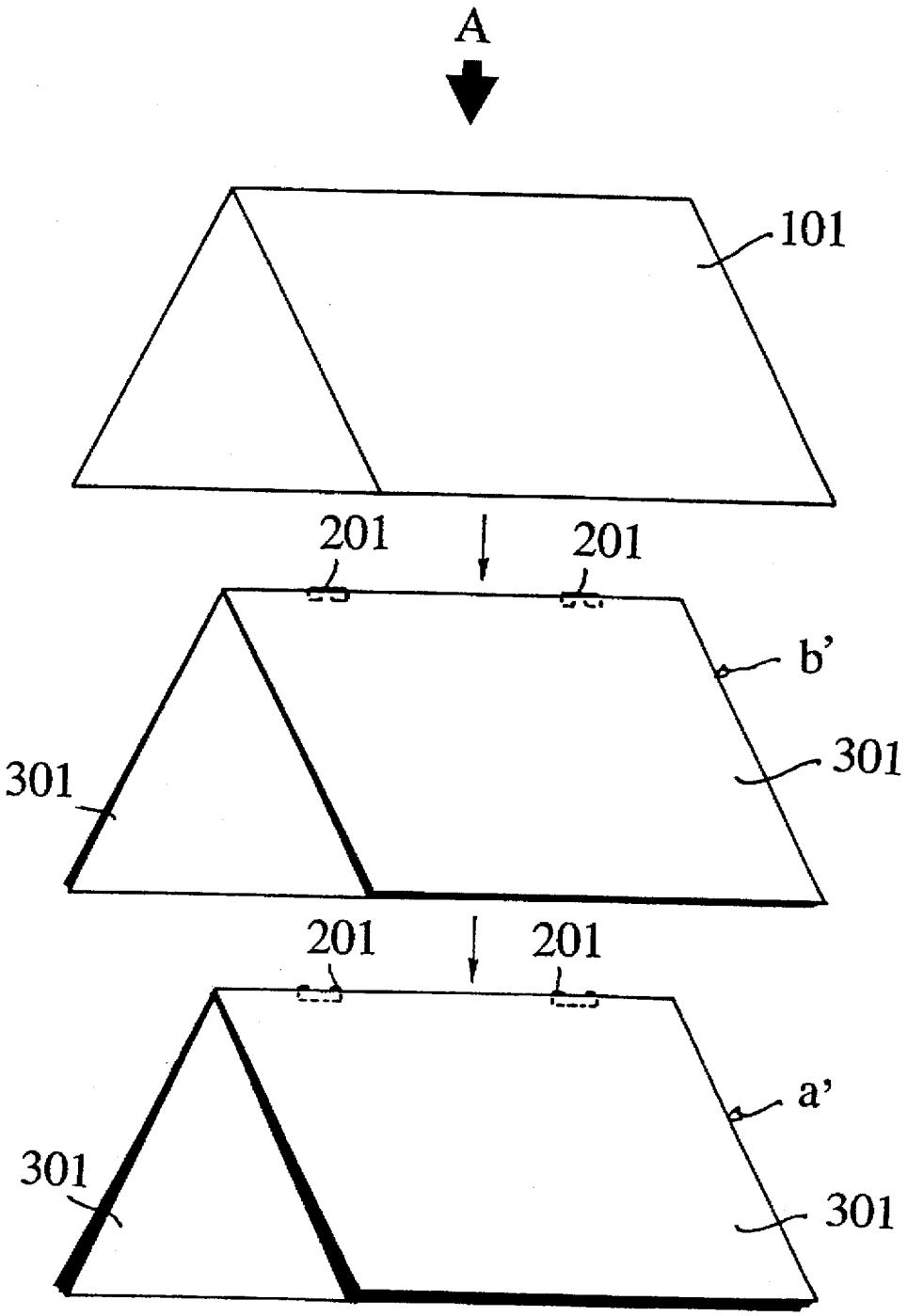
FIG. 7 is an exploded perspective view of another embodiment of a saddle-stitched book.
Figure 8:
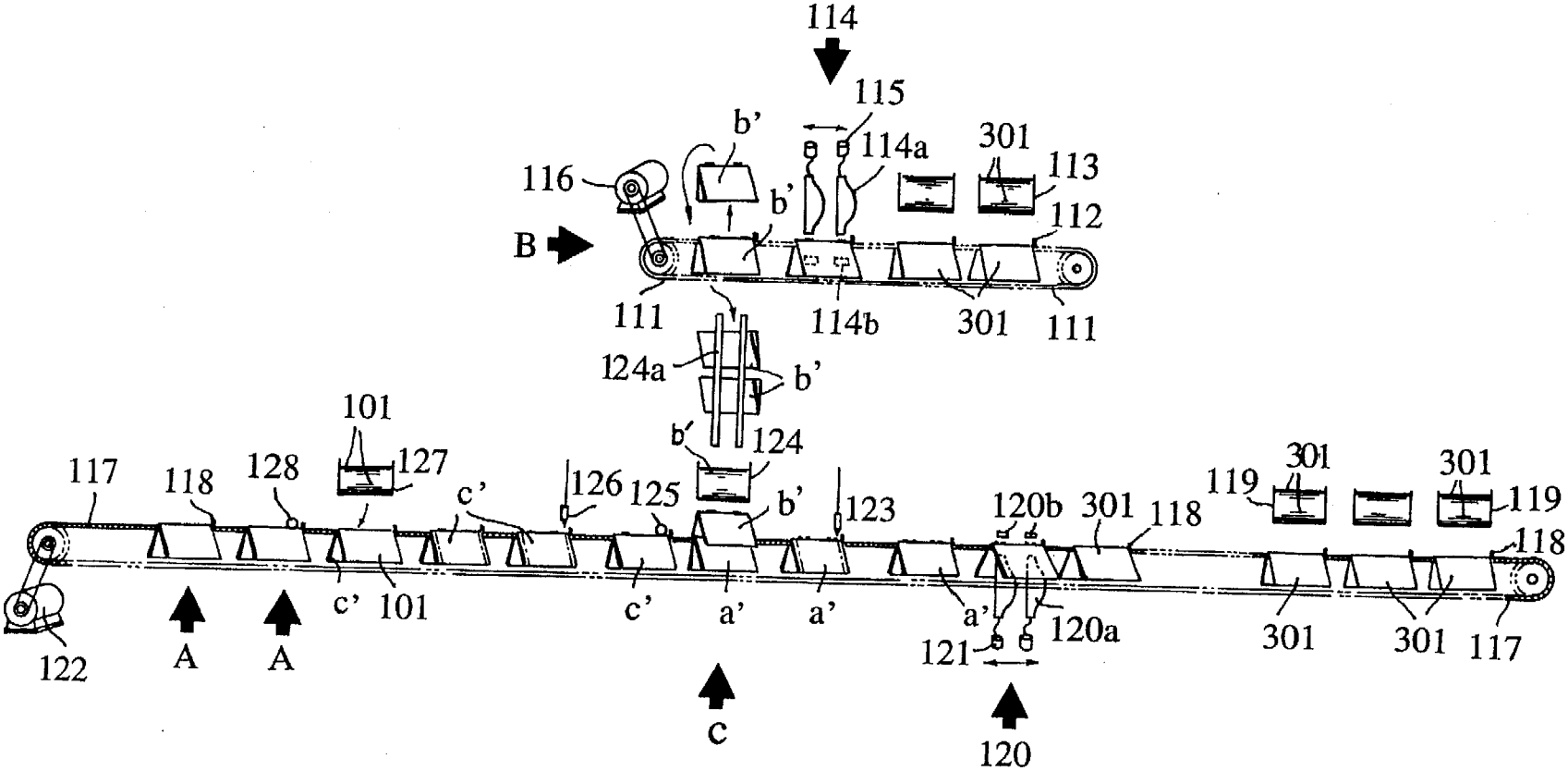
FIG. 8 is an explanatory view of an apparatus used for carrying out a saddle-stitching method.

FIGS. 6, 7 and 8 show an embodiment which corresponds to claim 4. In FIG. 6, symbol a' denotes a back-saddle-stitched book, and symbol b' denotes a front-saddle-stitched book with a cover 1 stitched together. A saddle-stitched book A is prepared by joining the backs of the saddle-stitched books a' and b' to each other by adhesion with the front-saddle-stitched book b' lying on the back-saddle-stitched book a'. FIG. 7 shows a saddle-stitched book A prepared by, in the embodiment of FIG. 6, separately preparing a cover 101 and the front-saddle-stitched book b', joining the cover 101 to the back surface of the front-saddle-stitched book b' by adhesion, and hiding a stitching wire 201 of the front-saddle-stitched book b' by means of the cover 101. In addition, it is possible to simplify and improve the productivity of bookbinding by preparing the front-saddle-stitched book b' as a thin structure which contains a small number of body signatures 301 and by preparing the back-saddle-stitched book a' as a thick one which contains a large number of body signatures 301. Furthermore, although not specifically shown, it is possible to stabilize the saddle-stitched book A by displacing the stitcher positions of the back-stitched book a' and the front-saddle-stitched book b' from each other and preventing superposition of upper and lower stitching wires 201.

In this manner, in the saddle-stitched book A of the present invention, since the front-saddle-stitched book b' is stacked on and bonded to the back-saddle-stitched book a', the straight portions of the stitching wire 201 are positioned inside and outside the saddle-stitched book A, and the opposite bent end portions of the stitching wire 201 are buried in the portion between the butted backs of the back-saddle-stitched book a' and the front-saddle-stitched book b', more specifically, in the thick inside portion of the saddle-stitched book A. Accordingly, children cannot easily break up the saddle-stitched book A out of mischief, and their fingers are prevented from being hurt during such mischief. In addition, since the stitching wire 201 of the front-saddle-stitched book b' is hidden by the cover 101, it is possible to improve safety and the aesthetic effect of bookbinding to a further extent.

An apparatus for carrying out the bookbinding method of the present invention will be described below with reference to FIG. 8.

Reference numeral 111 denotes a conveying chain mechanism having two parallel chains which is installed on a machine frame (not shown). Pusher mechanisms 112 are disposed at predetermined intervals along the conveying chain mechanism 111 so that they can be brought into abutment with both sides of the rear ends of the aforesaid body signatures 301 to carry these signatures at a predetermined conveying speed. A plurality of body-signature feeders 113 which are needed for bookbinding the aforesaid front-saddle-stitched book b' are disposed in parallel above the upstream side of the conveying chain mechanism 111, and the required number of body signatures 301 which are sequentially fed from the respective body-signature feeders 113 are stacked as shown, and are conveyed toward the downstream side by the conveying chain mechanism 111 and the pusher mechanisms 112.

A set of two stitching members 114*a*, which travels back and forth by a constant stroke at the same speed and in the same direction as the conveying chain mechanism 111 to saddle-stitch the back of the gathered body signatures 301 from above and form the front-saddle-stitched book b', is provided in a downward extending manner above the portion of the conveying chain mechanism 111 which is beyond the body-signature feeder 113 located on the most downstream side. Stitching-wire pressing members 114*b* which are moved back and forth in correspondence with the respective stitching members 114*a* are oppositely provided below the body signatures 301. A front-saddle-stitcher mechanism 114 is made up of the stitching members 114*a* and the stitching-wire pressing members 114*b*. In FIG. 8, reference numeral 115 denotes a steel-wire bobbin, and reference numeral 116 denotes a driving motor. A bookbinding line B for the front-saddle-stitched book b' is constructed of the above-described constituent elements.

In FIG. 8, reference numeral 117 denotes a conveying chain mechanism having two parallel chains which is installed on a machine frame (not shown). Pusher mechanisms 118 are disposed at predetermined intervals along the conveying chain mechanism 117 so that they can be brought into abutment with both sides of the rear ends of the body signatures 301 to carry these signatures at a predetermined conveying speed. A plurality of body-signature feeders 119 which are needed for bookbinding the aforesaid back-saddle-stitched book a' are disposed in parallel on the upstream side of the conveying chain mechanism 111, and the required number of body signatures 301 which are sequentially fed from the respective body-signature feeders 119 are stacked as shown, and are conveyed toward the downstream side by the conveying chain mechanism 117 and the pusher mechanisms 118.

Stitching members 120*a*, which travel back and forth by a constant stroke at the same speed and in the same direction as the conveying chain mechanism 117 to saddle-stitch the gathered body signatures 301 from the downstream side and form the back-saddle-stitched book a', are uprightly provided below the middle portion of the conveying chain mechanism 117 which is beyond the body-signature feeder 119 located on the most downstream side. Stitching-wire pressing members 120*b* which are moved back and forth in correspondence with the top portions of the back sides of the respective stitching members 120*a* are adjacently provided above the back of the body signatures 301. A back-stitching stitcher mechanism 120 is made up of the stitching members 120*a* and the stitching-wire pressing members 120*b*. In FIG. 8, reference numeral 121 denotes a steel-wire bobbin, and reference numeral 122 denotes a driving motor.

A nozzle 123 for spraying paste downwardly is disposed so that it can be adjustably moved up and down, on the downstream side of the stitcher mechanism 120 and above the conveying chain mechanism 117, more specifically, at a position above the conveying chain mechanism 117 where the nozzle 123 does not contact the back surface of the back-saddle-stitched book a' which consists of the body signatures 301 which are moving. The nozzle 123 is arranged to be operated by, for example, a controller which receives a collator speed signal from a rotary encoder, and is capable of performing spot-spraying with paste, intermittent spraying, continuous spraying, and automatic spraying according to the length of the body signatures 301. In particular, the nozzle 123 can be controlled so that the paste can be sprayed onto a back portion excluding head and tail margins 301*a* of the respective front and rear end portions of the back of the body signatures 301, i.e., the back-saddle-stitched book a'.

In addition, a feeder 124 to which the front-saddle-stitched book b' prepared by the bookbinding line B is to be supplied from the terminal end of the bookbinding line B via transfer guiding means 124*a* is disposed above the downstream side of the nozzle 123. The front-saddle-stitched book b' which is fed from the feeder 124 is stacked on the back-saddle-stitched book a' which is moving with its back sprayed with the paste, and the back is pressed by a pressure roller 125 to promote the bonding of both saddle-stitched books a' and b', thereby preparing a composite saddle-stitched book c'. Another nozzle 123 for spraying paste downwardly, which has a function similar to that of the nozzle 123, is disposed so that it can be adjustably moved up and down, above the downstream side of the feeder 124, more specifically, at a position above the conveying chain mechanism 117 where the nozzle 126 does not contact the back surface of the front-saddle-stitched book b' which constitutes the composite saddle-stitched book c'. In addition, a cover signature feeder 127 is disposed above the downstream side of the nozzle 126. The cover 101 fed from this feeder 127 is attached to the back side of the front-saddle-stitched book b' which is sprayed with the paste and which constitutes the composite saddle-stitched book c', and the back side is pressed by a pressure roller 128, whereby the efficiency of bonding can be enhanced. The saddle-stitched book A to which the dover 101 is bonded is sent to a three-side trimmer (not shown), and the head, tail and fore edge margins of the saddle-stitched book A are decoratively cut by the three-side trimmer, thus providing a product.

Figure 9:
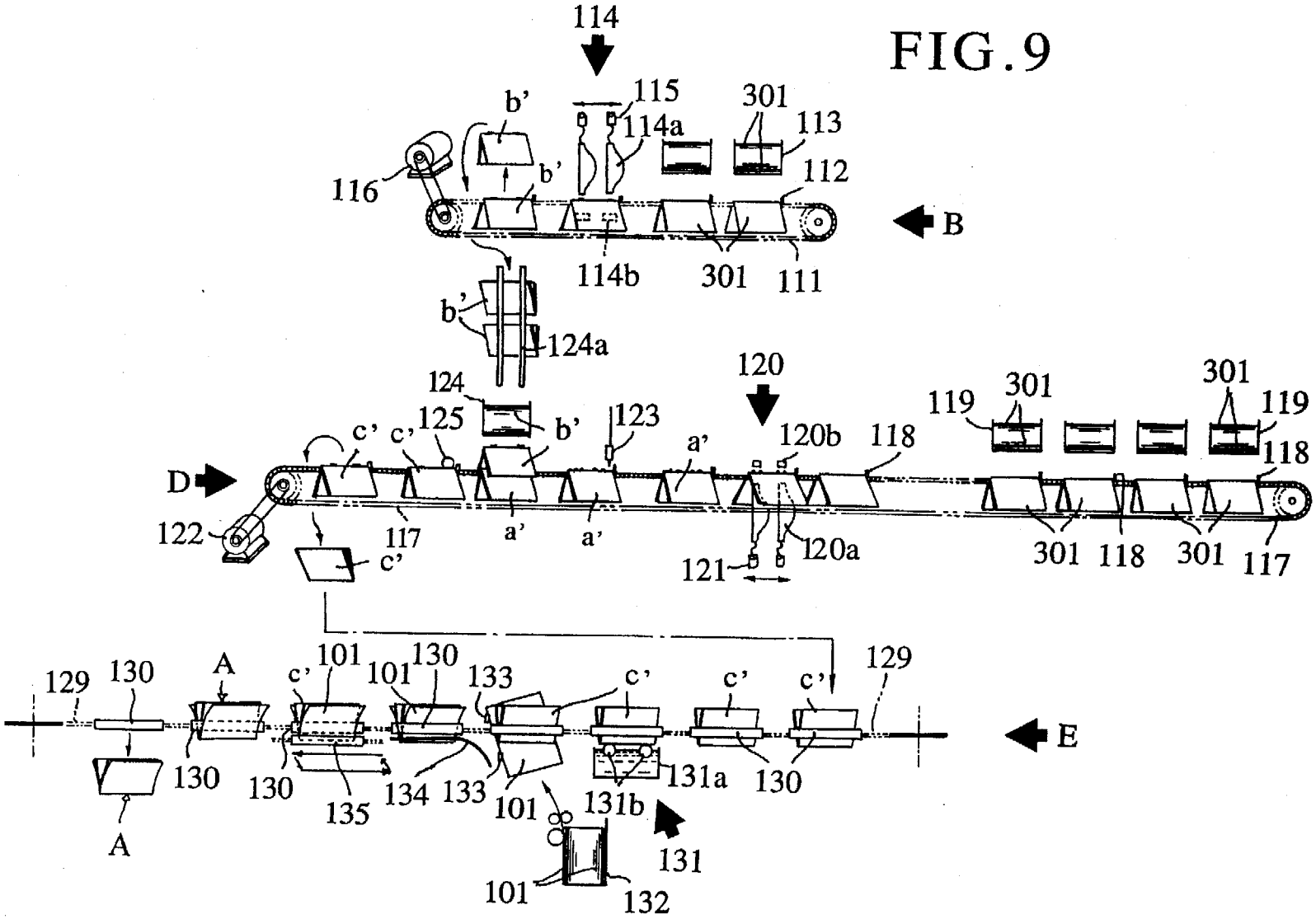
FIG. 9 is an explanatory view showing another embodiment of the apparatus.

FIG. 9 shows an apparatus for carrying out a bookbinding method of the present invention which corresponds to claim 5. This apparatus is formed by a connection of bookbinding lines B, D and E. Since bookbinding line B is identical to the bookbinding line B of the aforesaid embodiment shown in FIG. 8, the detailed description thereof is omitted. In the bookbinding line D, the nozzle 126 for spraying paste downwardly, which is provided on the downstream side of the feeder 124 for the front-saddle-stitched book b', the cover signature feeder 127, the pressure roller 128 and associated constituent elements are omitted from the bookbinding line C shown in FIG. 8. The bookbinding line D is shorter than the bookbinding line C by that amount. Since the other constituent elements are similar to those of the embodiment of FIG. 8, identical reference numerals are used to denote identical constituent elements, and the detailed description thereof is omitted.

The construction of the bookbinding line E will be described below. Reference numeral 129 denotes a conveying chain mechanism which is installed so that a forward path and a backward path horizontally turn with respect to a machine frame which is not shown. The conveyance terminal end of the conveying chain mechanism 117 and the conveyance starting end of the backward path of the conveying chain mechanism 129 are connected by means for reversing the composite saddle-stitched book c' by 180°. Clamping means 130 for clamping the right and left intermediate portions of the aforesaid composite saddle-stitched book c' are attached to the conveying chain mechanism 129 at predetermined intervals, and a device 131 for applying paste to the back of the front-saddle-stitched book b' which constitutes the composite saddle-stitched book c' is disposed below a halfway portion of the backward path of the conveying chain mechanism 129. The paste applying device 131 is arranged to uniformly apply the paste contained in a tank 131*a*, by touch with two parallel rotating rollers 131*b*, and it is desirable that the paste applying device 131 can be adjustably moved up and down so that its touch with the back of the back-saddle-stitched book c' can be made uniform.

A cover feeder 132 is disposed below the downstream side of the paste applying device 131, and stoppers 133 for temporarily stopping one flat cover 101, which is fed from the cover feeder 132, independently of the backward run of the conveying chain mechanism 129 are provided so that they can move up and down in the state of opposing each other across the chain. In addition, a guide rod 134 for pressing and bonding the cover 101*a* to the back of the composite saddle-stitched book c' which is clamped and supported by the clamping means 130 in the state of being folded upwardly into two along the center line is provided on the downstream side of the stoppers 133. Clamping means 135, which is positioned below the clamping means 130 and clamps and supports both sides of the back of the composite saddle-stitched book c' by a short distance, is disposed on the downstream side of the guide rod 134. This clamping means 135 is arranged to be able to perform operations, i.e., clamping the back, separation, returning and clamping the back, with good timing within a limited section, as indicated by arrows. At the terminal end of the backward path of the conveying chain mechanism 129, the clamping and supporting by the clamping means 130 is released and the saddle-stitched book A is obtained with the exposed portion of the stitching wire of the front-saddle-stitched book b' which constitutes the composite saddle-stitched book c' being hidden by the cover 101. Then, the head, tail and fore edge margins of this saddle-stitched book A are decoratively cut by a three-side trimmer (not shown), thus providing a bound book.

As described above, according to the constitution of the present invention, it is possible to obtain the following effects.

(a) A back-saddle-stitched book which is held by the straight portion of a stitching wire in the inside of stacked body signatures is obtained, and the opposite bent end portions of the stitching wire which are exposed on the back side of this back-saddle-stitched book are hidden by a cover signature. Accordingly, it is possible to easily obtain a saddle-stitched book which cannot be easily broken out of mischief by children.

(b) By spraying paste onto a portion of the back of a back-saddle-stitched book which excludes its head and tail cutting margins each having a predetermined length, when the head and tail margins are cut by a three-side trimmer, the paste is prevented from adhering to a cutter and impairing the sharpness thereof, so that the entire bookbinding operation is not interrupted by cutter cleaning or the like. Accordingly, it is possible to improve the efficiency of bookbinding.

(c) The back-saddle-stitched book is clamped and supported by clamping means in a 180°-reversed attitude with its back facing down, and the back in this attitude is sprayed with paste and a cover is stuck on the back. Accordingly, it is possible to improve the efficiency of pasting, by selectively using paste materials according to the paper quality of a body signature or a cover and by using either of the pasting means shown in FIG. 1 or 5.

(d) Since a front-saddle-stitched book is stacked on and bonded to a back-saddle-stitched book, the bent end portions of the stitching wires of both saddle-stitched books are buried in the saddle-stitched book, so that the bent end portions of the stitching wires does not at all appear on any surface. Accordingly, children do not have an chance of breaking up the book, and their fingers or others are prevented from getting hurt out of mischief.

(e) By attaching a cover later, it is possible to hide the stitching wire of the front-saddle-stitched book, so that the effect described in Paragraph (a) can be improved to a further extent.

(f) The bookbinding lines B, C and D, E which constitute a connected line can be used as independent front-saddle-stitching bookbinding lines or independent back-saddle-stitching bookbinding lines, respectively, so that saddle-stitched books suited to desired purposes can be bound on one apparatus and switching of the lines is easy.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

We claim:

1. A bookbinding method for a saddle stitched bound book, comprising the steps of:

feeding body signatures from a plurality of body signature feeders which are disposed in parallel to conveying means below said body signature feeders and stacking said body signatures on said conveying means;

obtaining a back-saddle-stitched book of said body signatures by back-saddle-stitching a back portion of said stacked body signatures from below;

spraying paste along a predetermined width on a back surface of said back-saddle-stitched book;

feeding a cover signature from a cover signature feeder to the top of said back-saddle-stitched book;

pressing a back side of said cover signature via a pressing means and bonding said cover signature to a back side of said back-saddle-stitched book;

obtaining a saddlestitched bound book by cutting head, tail and fore edge margins via a three-side trimmer;

wherein said paste is sprayed onto a back portion of said back-saddle-stitched book which excludes front and rear predetermined lengths of said back portion of said back-saddle-stitched book.

2. A bookbinding method for a saddlestitched bound book, comprising the steps of:

sequentially feeding body signatures from a plurality of body signature feeders which are disposed in parallel to conveying means below said body signature feeders and stacking said body signatures on said conveying means;

obtaining a back-saddle-stitched book of said body signatures by back-saddle-stitching a back portion of said stacked body signatures from below;

sequentially transferring said obtained back-saddle-stitched book to clamping means of another conveying means in a 180°-reversed attitude with a back thereof facing down;

spraying paste onto said down-facing back of said back-saddle-stitched book halfway during conveyance by said conveying means;

feeding said back-saddle-stitched book sprayed with said paste to a top of a cover signature which is fed from a cover signature feeder to a downstream side of said conveying means and is on standby in a temporarily stopped state independently of a motion of said conveying means;

bonding said cover signature to the back side of said back-saddle-stitched book by clamping said back side via still another clamping means while conveying said back-saddle-stitched book together with said cover signature;

and, after releasing said back-saddle-stitched book from said clamping means, decoratively cutting head, tail and fore edge margins by using a three-side trimmer to obtain a saddle-stitched bound book.

3. A bookbinding method for a saddle-stitched bound book, comprising the steps of: sequentially feeding body signatures from a plurality of body signature feeders which are disposed in parallel to conveying means below said body signature feeders and stacking said body signatures on said conveying means;

obtaining a front-saddle-stitched book of said body signatures by saddle-stitching a back portion of said stacked body signatures from above;

feeding said front-saddle-stitched book to a front-saddle-stitched signature feeder;

meanwhile, sequentially feeding body signatures from a plurality of body signature feeders which are disposed in parallel to conveying means below said body signature feeders and stacking said body signatures on said conveying means;

obtaining a back-saddle-stitched book of said body signatures by back-saddle-stitching a back portion of said stacked body signatures from below;

spraying paste along a predetermined width on a back surface of said back-saddle-stitched book;

feeding said front-saddle-stitched book from said front-saddle-stitched signature feeder to the top of said back-saddle-stitched book;

bonding said front-saddle-stitched book to a back side of said back-saddle-stitched book to obtain a composite saddle-stitched book; and obtaining a saddle-stitched bound book by decoratively cutting head, tail and fore edge margins of said composite saddle-stitched book via a three-side trimmer.

4. A bookbinding method for a saddle-stitched bound book comprising the steps of:

sequentially feeding body signatures from a plurality of body signature feeders which are disposed in parallel to conveying means below said body signature feeders and stacking said body signatures on said conveying means;

obtaining a front-saddle-stitched book of said body signatures by saddle-stitching a back portion of said stacked body signatures from above;

feeding said front-saddle-stitched book to a front-saddle-stitched signature feeder;

meanwhile, sequentially feeding body signatures from a plurality of body signature feeders which are disposed in parallel to conveying means below said body signature feeders and stacking said body signatures on said conveying means;

obtaining a back-saddle-stitched book of said body signatures by back-saddle-stitching a back portion of said stacked body signatures from below;

spraying paste onto along a predetermined width on a back surface of said back-saddle-stitched book;

feeding said front-saddle-stitched book from said front-saddle-stitched signature feeder to the top of said back-saddle-stitched book;

bonding said front-saddle-stitched book to a back side of said back-saddle-stitched book to obtain a composite saddle-stitched book;

sequentially transferring said composite saddle-stitched book to clamping means of another conveying means in a 180°-reversed attitude with its back facing down;

spraying paste onto the lower surface of a back portion of said composite saddle-stitched book halfway during conveyance by said conveying means;

feeding said composite saddle-stitched book sprayed with said past to the top of a cover signature which is fed from a cover signature feeder to a downstream side of said conveying means and is on standby in a temporarily stopped state independently of a motion of said conveying means;

bonding said cover signature to the back side of said back-saddle-stitched book by clamping said backside via another clamping means while conveying said composite saddle-stitched book together with said cover signature; and, after releasing said composite saddle-stitched book from said clamping means, decoratively cutting head, tail and fore edge margins by using a three-side trimmer to obtain a saddle-stitched bound book.

* * * * *